US005191853A

United States Patent [19]

Adler

[11] Patent Number: 5,191,853

[45] Date of Patent: Mar. 9, 1993

[54] STEPPED HYDROPLANE HULL

[76] Inventor: Alan J. Adler, 752 La Para Ave., Palo Alto, Calif. 94306

[21] Appl. No.: 705,240

[22] Filed: May 24, 1991

[51] Int. Cl.[5] ..... B63B 1/20

[52] U.S. Cl. ..... 114/291; 114/292

[58] Field of Search ..... 244/105, 106; 446/160; D12/300, 309; 114/271, 274, 291, 292, 56, 62, 289, 290, 288; 441/65, 68

[56] References Cited

U.S. PATENT DOCUMENTS

| | | | |
|---|---|---|---|
| 956,487 | 4/1910 | Fauber | 114/291 |
| 1,024,682 | 4/1912 | Fauber | 114/291 |
| 2,029,215 | 1/1936 | Agwood | 114/292 |
| 2,162,705 | 6/1939 | Diehl | 114/291 |
| 2,181,875 | 12/1939 | Diehl | 114/291 |
| 2,909,140 | 10/1959 | Kiekhaefer | 114/291 |
| 3,661,109 | 5/1972 | Weiland | 114/291 |
| 4,356,787 | 11/1982 | Harley | 114/292 |
| 4,509,927 | 9/1985 | Ikeda | 114/291 |

OTHER PUBLICATIONS

Offshorer Marine Catalog (Italy, date unknown).

L. Benen, "General Resistance Test of a Shallow Step Planing Hull . . . ", NSRDC Report 2169, May 1966.

L. Benen, "General Resistance Test of a Stepped Planing Hull With . . . ", NSRDC Report 2320, May 1967.

E. P. Clement, "The Design of Cambered Planing Surfaces for Small Motorboats", NSRDC Report 3011, Mar. 1969.

J. B. Parkinson, "Tank Tests of a Model of a Flying-Boat Hull Having a . . . ", NACA Technical Note 545.

NACA Technical Note 551.

NACA Technical Note 563.

"Skater", Powered Offshore Racing Catamaran.

Photo of Speedboat "Miss England III".

*Primary Examiner*—Joseph F. Peters, Jr.

*Assistant Examiner*—Clifford T. Bartz

*Attorney, Agent, or Firm*—Townsend and Townsend

[57] ABSTRACT

A hydroplane hull according to the present invention comprises a forebottom surface and an afterbottom surface connected by a step. The afterbottom surface has an aft portion formed with a positive trim angle and a forward portion with a non-negative trim angle which is of lesser angle than that of the aft portion.

6 Claims, 4 Drawing Sheets

STEPPED HYDROPLANE HULL

BACKGROUND OF THE INVENTION

The present invention relates generally to watercraft and devices for providing lift or support on water or other liquids, and more specifically to an efficient hydroplane hull. A hydroplane hull is defined in this specification to include a wide range of planing devices supported by the dynamic pressure of water including power boats, sail boats, water skis, surfboards, sailboards, flying boat hulls, flying boat pontoons, and the like.

The concept of stepped planing hulls is more than 100 years old and is first attributed C. M. Ramus of England in 1852. In theory stepped hulls offer better control of overall trim angle, especially at very high speeds where unstepped hulls are unable to maintain sufficient trim angle. In practice however, stepped hulls have always constituted a small minority of planing hulls. It is believed that this is because of the sub optimum configurations of all known prior art.

Some known patents on stepped hulls include U.S. Pat. Nos. 956,487 to Fauber, 1,024,682 to Fauber, and 3,661,109 to Weiland.

Literature referring to stepped hulls includes: Offshorer Marine catalog (Italy, date unknown); Benen, NSRDC Reports 2169 and 2320; Clement, NSRDC Report 3011—March 1969; Flying boat hulls such as illustrated in NACA Technical Notes 545, 551, and 563; "Skater", powered offshore racing catamaran; and a photo of speedboat "Miss England III".

SUMMARY OF THE INVENTION

A hydroplane hull according to the present invention comprises a forebottom surface and an afterbottom surface connected by a step. The afterbottom surface has an aft portion formed with a positive trim angle and a forward portion with a non-negative trim angle which is of lesser angle than that of the aft portion with an abrupt angular transition of trim angle between said forward and aft portions. For purposes of this disclosure an abrupt angular transition is defined as an angular transition which occurs over a longitudinal length not exceeding one-half of the maximum beam dimension of the hull.

The advantages of the present invention can best be understood by comparing the performance characteristics with those of the prior art. For example, Ramus, Fauber, Weiland, and others disclose hulls with similar and constant trim angles for both the forebottom and afterbottoms. With constant afterbottom trim angle, either the step height is too great for efficient operation at pre-planing speeds or the afterbottom elevation is too low. If the step height is too great, pre-planing drag is excessive, the structural strength is weakened, and the interior volume is reduced. If the afterbottom elevation is too low its lift pitches the hull forward, reducing both the entire trim angle and the efficiency. The afterbottom of the present invention has a reduced trim angle in the forward portion near the step. This permits the combination of optimum step height, optimum afterbottom elevation, and optimum trim angle for the aft portion of the afterbottom.

Flying boat hulls or floats are configured with afterbottoms which lift out of the water at planing speeds and thus do not contribute to lift or pitch stability. The afterbottom of the present invention is designed to stay in the water and provide lift and trim stability.

The speedboat "Miss England III" has an S-shaped afterbottom trim. The trim angle of the middle portion of the "S" is negative. This produces suction at any speed wherein the separated flow behind the step re-contacts the bottom in middle portion of the "S". Suction, of course, greatly increases drag. The present invention has no portion of negative bottom trim and thus no accompanying suction.

Fauber, U.S. Pat. No. 956,487, discloses an extendable and flexible afterbottom surface which, when extended, has a gradual transition between a lower trim angle for the forward portion to a greater trim angle at the aft portion. While this can perform satisfactorily at high speeds it is inferior to the present invention at intermediate planing speeds when the separated flow behind the step re-contacts the intermediate portion of the afterbottom where the trim angle is lower than optimum and thus produces higher drag. This will be explained in greater detail below.

A further understanding of the nature and advantages of the present invention can be realized by reference to the remaining portions of the specification and the drawings.

DESCRIPTION OF SPECIFIC EMBODIMENT

Figure 1A:
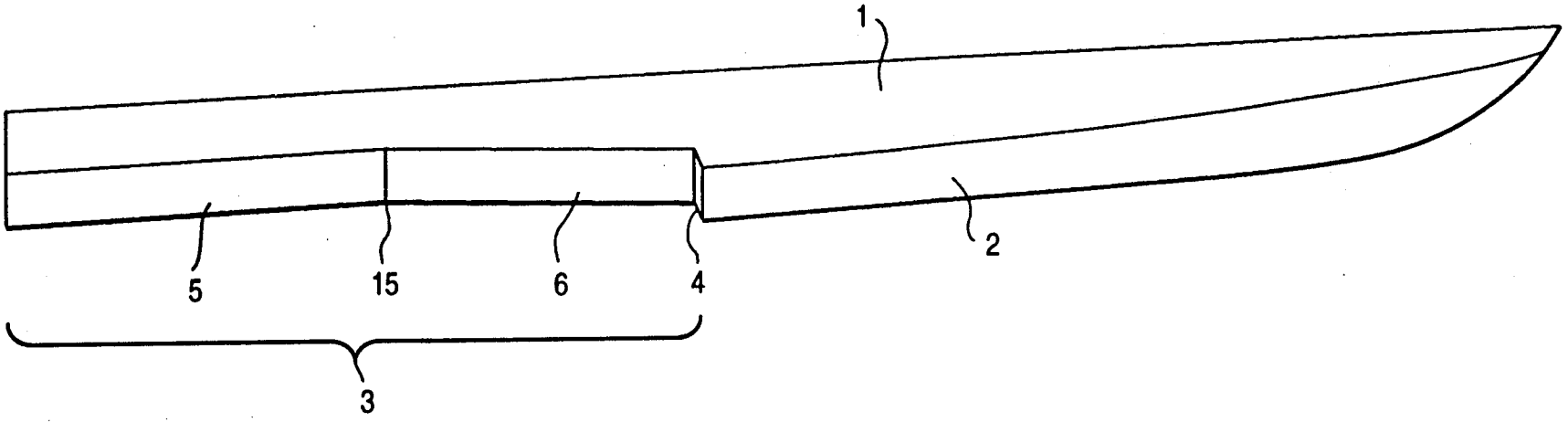
FIGS. 1A and 1B are elevation and body plan views of the invention.
Figure 1B:
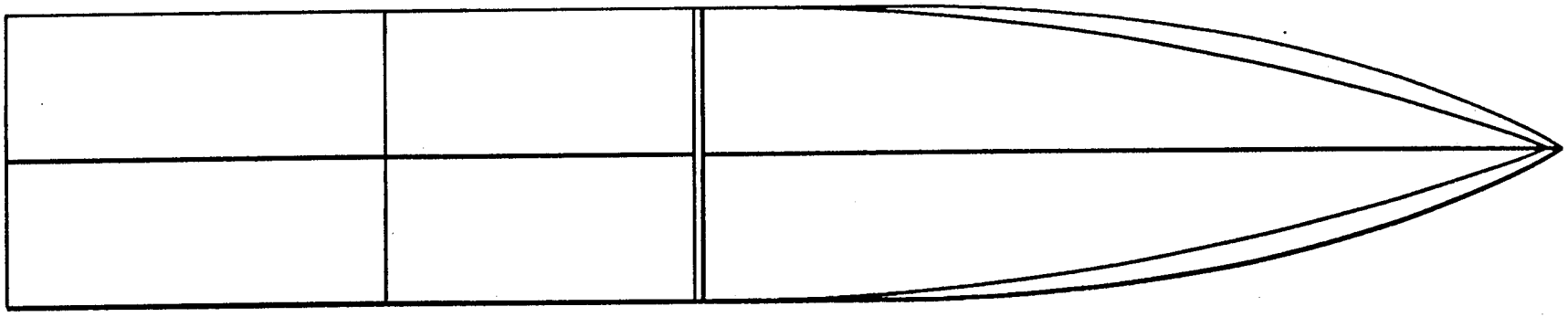

The invention of FIGS. 1A and 1B comprises a hydroplane hull 1 with a forebottom surface 2 and an afterbottom surface 3 connected by a vertical step 4. Step 4 traverses the entire width of the forebottom and afterbottom surfaces. The afterbottom surface has an aft portion 5 formed with a positive trim angle and a forward portion 6 with a non-negative trim angle which is less than the trim angle of the aft portion. Note that at region 15 there is an abrupt change in said trim angles of said forward and aft portions.

The present inventor has discovered that greatest efficiency results when the forward portion of the afterbottom has less trim angle than the aft portion. This permits simultaneous optimization of three important parameters: The trim angle of the aft portion of the afterbottom relative to the forebottom; the elevation of the aft portion of the afterbottom relative to the forebottom; and the step height of the hull. Simultaneous optimization of all three above parameters is not possible if the forward portion of the afterbottom does not have a lesser trim angle than the aft portion as will be explained below.

Figure 2:
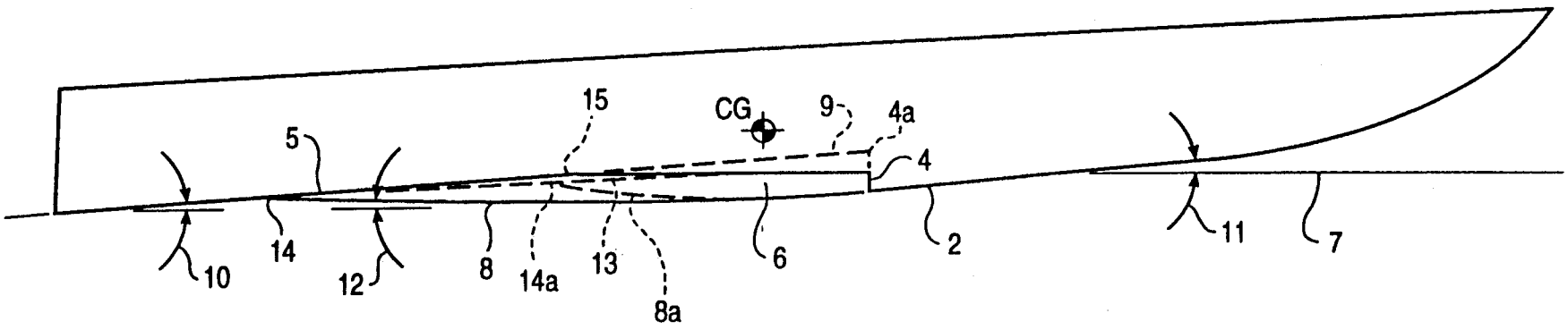
FIG. 2 is an elevation diagram of the invention and the contour of water flow while planing.

FIG. 2 is an elevation diagram of the invention and the resultant water surface contour while planing. Note that the water surface 7 first contacts the forebottom surface 2. The positive trim angle 11 of forebottom 2 deflects the wake 8 downward behind step 4. Wake 8 then re-contacts the aft portion 5 of the afterbottom at location 14.

In FIG. 2, trim angle 10 of the aft portion 5 of the afterbottom is drawn at the optimum angle, which is normally zero to one degree less than forebottom trim angle 11. In FIG. 2, the forebottom trim angle 11 is five degrees and afterbottom trim angle 10 is four degrees.

Considering first forebottom trim angle 11, it is well known to those skilled in the art of planing hull design that minimum drag occurs at a specific trim angle which is usually in the range of four to five degrees depending on hull deadrise angle and the ratio of hull beam to wetted length. In this example, the angle is five degrees. For minimum drag, afterbottom trim angle 10 should be slightly lower than the forebottom trim angle to take advantage of the slightly positive slope 12 of wake 8. Thus it can be seen that there is an optimum trim angle for afterbottom 5. Any departure from this optimum angle will increase drag.

Furthermore, it can be seen from examination of FIG. 2 that there is an optimum elevation for afterbottom 5. If elevation 5 were lower, the stern of the hull would be lifted higher, which in turn would reduce the trim angle of the entire hull and thus increase drag. Conversely if the elevation of afterbottom 5 were higher, the stern of the hull would plane at a lower height and the trim angle of the entire hull would be increased—once again departing from the minimum drag of the optimum angle. Thus it can be seen that any departure from the optimum elevation of afterbottom 5 will increase drag.

The dashed line 9 of FIG. 2 illustrates a prior art configuration in which only two of the above three parameters are optimized. Here the trim angle of the entire afterbottom is at the same optimum angle 10 and the elevation of the aft portion is also optimum. The result is a much higher step 4*a*. While there is no hydrodynamic penalty for this higher step at planing speeds, there are very substantial drag penalties at pre-planing speeds. Furthermore, the higher step 4*a* results in a hull of weaker structural strength and reduced interior volume. In the case of hulls with very small vertical dimension, such as water skis, or sailboards, the higher step 4*a* is not even practical.

It is also possible to optimize step height and afterbottom elevation at the cost of sub-optimum afterbottom trim angle, or to optimize step height and afterbottom trim angle at the cost of sub-optimum afterbottom elevation. But it is not possible to optimize all three parameters without the configuration of the present invention.

The configuration of the present invention, with an afterbottom portion 6 having a lesser trim angle, simultaneously optimizes all three important parameters. It is noted also that the optimum step height is the least height which will insure separation of wake 8 from forebottom 2.

Dashed line 13 of FIG. 2 diagrams the prior art afterbottom of Fauber's (U.S. Pat. No. 956,487) flexible afterbottom surface when in its extended position. It can be seen from examination of line 13 that the trim angle of this afterbottom surface defined by line 13 is lower in the intermediate region immediately aft of region 15 than the trim angle of the present invention. Note that at intermediate speeds the wake will assume the form of dashed line 8*a* and will recontact the afterbottom at location 14*a*. At this location, the lower trim angle of the afterbottom surface of line 13 will result in higher drag than the present invention.

In the preferred embodiment of the present invention, step 4 or the region immediately aft of step 4 is ventilated to the atmosphere by air passages 16 which join the step with the atmosphere above the waterline and reduce suction and drag at pre-planing speeds when the step is entirely immersed.

Also in the preferred embodiment of the present invention, the deadrise angle of the afterbottom is less than that of the forebottom. This is to take advantage of the fact that the afterbottom planes on wake surface which has been partially smoothed by the forebottom. The present invention contemplates this lesser afterbottom deadrise angle as either a lesser positive angle, a zero angle, or even a negative (inverted vee) deadrise angle.

Figure 3A:
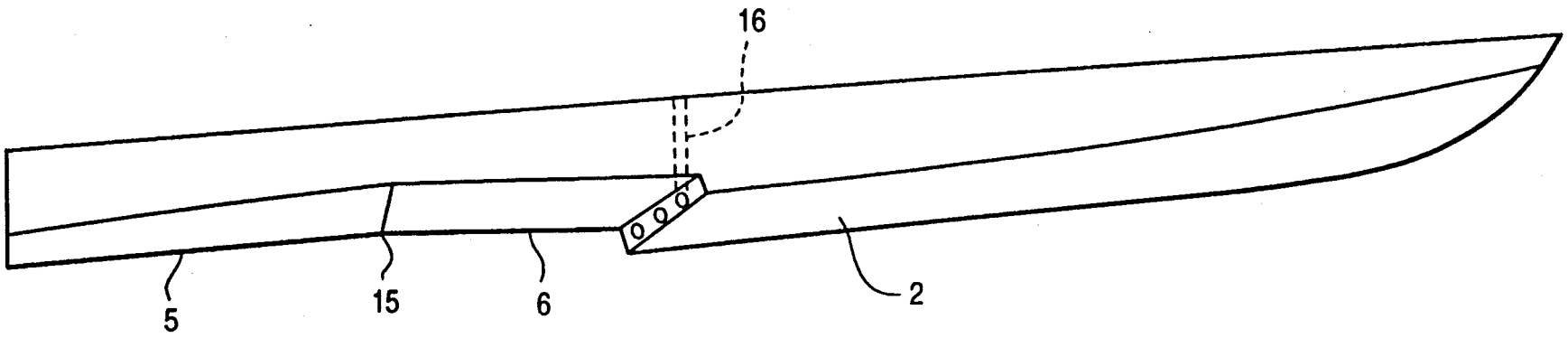
FIGS. 3A and 3B are elevation and body plan views of an alternative embodiment of the invention.
Figure 3B:
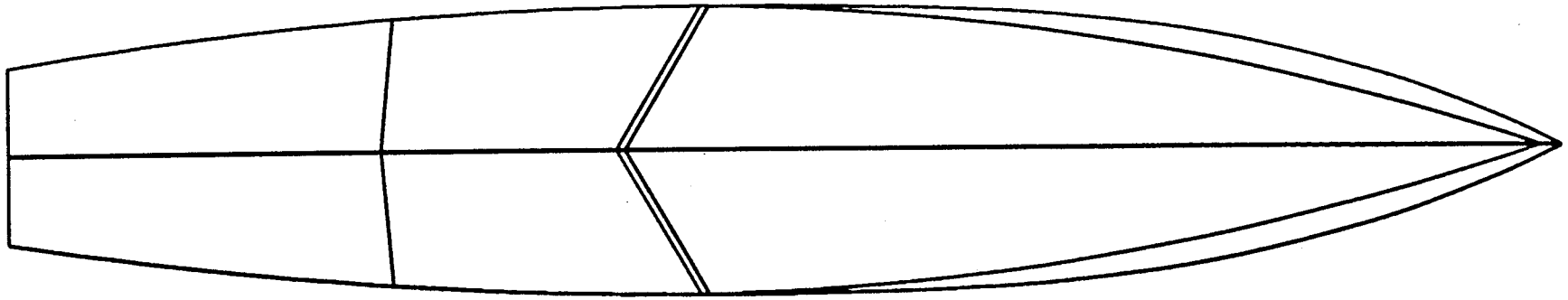

The planform of step 4 may be vee-shaped or diagonal, rather than transverse. Also, the beam of the afterbody may be tapered aft of the step. Such alternatives, which can decrease drag at pre-planing speeds but may increase planing drag, are illustrated in FIGS. 3A and 3B.

Figure 4A:
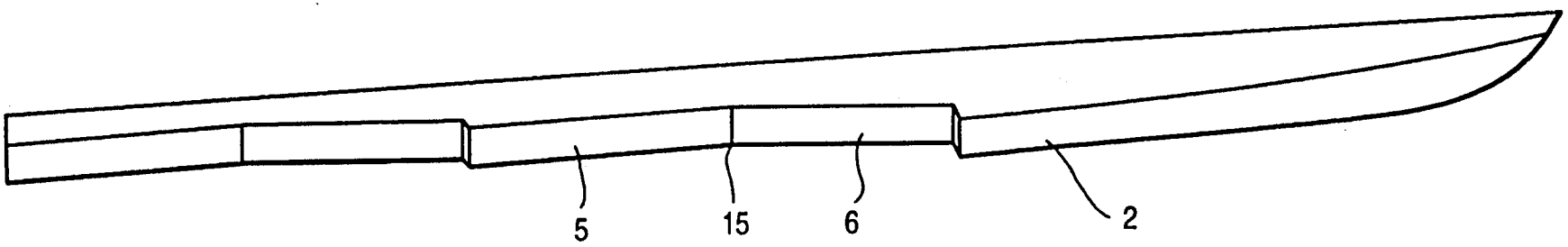
FIGS. 4A and 4B are elevation and body plan views of an alternative multiple step embodiment of the present invention.
Figure 4B:
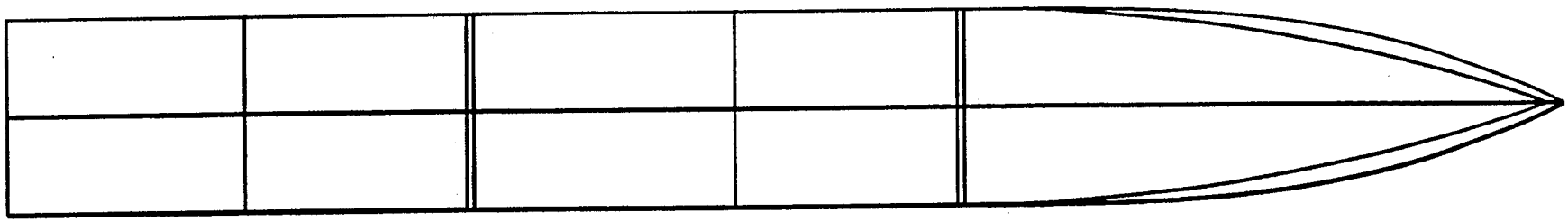

It is also contemplated that the configuration of the present invention can be incorporated in a hull having multiple steps as shown in FIGS. 4A and 4B.

While the above is a complete description of the preferred embodiment of the invention, various modifications, alternative constructions, and equivalents can be used. Therefore, the above description and illustration should not be taken as limiting the scope of the invention which is defined by the claims.

What is claimed is:

1. A hydroplane hull comprising a forebottom surface, an afterbottom surface, and a step;

said forebottom and afterbottom surfaces connected by said step which comprises an abrupt upward transition from said forebottom surface to said afterbottom surface such that water flow will separate from the hull bottom surface immediately aft of said step, said forebottom surface aligned with a positive trim angle relative to the horizontal water flow so as to provide hydrodynamic lift in said flow, an aft portion of said afterbottom surface formed with a positive trim angle relative to the water flow so as to provide lift when said separated water flow re-contacts said aft portion of said afterbottom surface, a forward portion of said afterbottom surface formed with a non-negative trim angle which is less than said trim angle of said aft portion of said afterbottom surface, said aft portion of said afterbottom surface formed with a trim angle which is 0.25 to 1 degree less than said trim angle of said forebottom surface, an abrupt angular transition of trim angle between said forward and aft portions of said afterbottom surface.

2. A hydroplane hull as recited in claim 1 comprising multiple steps.

3. A hydroplane hull as recited in claim 1 wherein said step, or the region immediately aft of said step, is ventilated.

4. A hydroplane hull comprising a forebottom surface, an afterbottom surface, and a step;

said forebottom and afterbottom surfaces connected by said step which comprises an abrupt upward transition from said forebottom surface to said afterbottom surface such that water flow will separate from the hull bottom surface immediately aft of said step, said forebottom surfaces aligned with a positive trim angle relative to the horizontal water flow so as to provide hydrodynamic lift in said flow, an aft portion of said afterbottom surface formed with a positive trim angle relative to the water flow so as to provide lift when said separated water flow re-contacts said aft portion of said afterbottom surface, a forward portion of said afterbottom surface formed with a non-negative trim angle which is less than said trim angle of said aft portion of said afterbottom surface, said forebottom surface having a deadrise angle and said afterbottom surface having a deadrise angle which is less than said deadrise angle of said forebottom surface, an abrupt angular transition of trim angle between said forward and aft portions of said afterbottom surface.

5. A hydroplane hull as recited in claim 4 comprising multiple steps.

6. A hydroplane hull comprising a forebottom surface, an afterbottom surface, and a step;

said forebottom and afterbottom surfaces connected by said step which comprises a ventilated abrupt upward transition from said forebottom surface to said afterbottom surface such that water flow will separate from the hull bottom surface immediately aft of said step, said forebottom surface aligned with a positive trim angle relative to the horizontal water flow so as to provide hydrodynamic lift in said flow, an aft portion of said afterbottom surface formed with a positive trim angle relative to said water flow so as to provide lift when said separated water flow re-contacts said aft portion of said afterbottom surface, a forward portion of said afterbottom surface formed with a non-negative trim angle which is less than said trim angle of said aft portion of said afterbottom surface, an abrupt angular transition of trim angle between said forward and aft portions of said afterbottom surface, said forebottom surface having a deadrise angle and said afterbottom surface having a lesser deadrise angle than that of said forebottom surface.

* * * * *